US006430852B2

(12) United States Patent
Murakami

(10) Patent No.: US 6,430,852 B2
(45) Date of Patent: Aug. 13, 2002

(54) COMPACT HYDRAULIC EXCAVATOR

(75) Inventor: Yoshiaki Murakami, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 09/813,987

(22) Filed: Mar. 22, 2001

(30) Foreign Application Priority Data

Mar. 31, 2000 (JP) ..... 2000-096640

(51) Int. Cl.[7] ..... E02F 9/08
(52) U.S. Cl. ..... 37/466
(58) Field of Search ..... 37/410, 403, 411, 37/466; 172/257, 810, 811, 330, 431, 432, 433, 434, 435, 436, 776

(56) References Cited

U.S. PATENT DOCUMENTS 5,806,622 A * 9/1998 Murphy ..... 180/210

FOREIGN PATENT DOCUMENTS

| | | |
|---|---|---|
| JP | 61-155457 | 9/1986 |
| JP | 3-47286 | 5/1991 |
| JP | 3-255241 | 11/1991 |
| JP | 9-195316 | 7/1997 |
| JP | 9-296481 | 11/1997 |
| JP | 10-280480 | 10/1998 |
| JP | 11-107316 | 4/1999 |
| JP | 11-269928 | 10/1999 |
| JP | 2000-38743 | 2/2000 |
| JP | 2000-73400 | 3/2000 |

* cited by examiner

*Primary Examiner*—Christopher J. Novosad
(74) *Attorney, Agent, or Firm*—Oblon, Spivak, McClelland, Maier & Neustadt, P.C.

(57) ABSTRACT

The present invention provides a compact hydraulic excavator comprising: a lower traveling body, an upper rotating body installed rotatably on the lower traveling body, an apparatus cover risen from a floor plate of the upper rotating body, an operator's seat arranged on the apparatus cover, an operator's seat fixing member for fixing the operator's seat, a cabin provided astride of the apparatus cover and the floor plate, the apparatus cover having the side and the back surface exposed to outside so that the cabin serves as a part of the side and the back surface, and a mounting plate projected substantially in a horizontal direction from the operator's seat fixing member, the side wall of the cabin being risen from the outer circumferential edge of the mounting plate. According to the present invention, it is possible to install a larger cabin than the size of an existing compact hydraulic excavator without newly re-designing an apparatus cover.

7 Claims, 4 Drawing Sheets

COMPACT HYDRAULIC EXCAVATOR

BACKGROUND OF THE INVENTION

1. Field of the Invention

The present invention relates to a compact hydraulic excavator having a cabin installed thereon.

2. Description of the Related Art

Conventionally, the compact hydraulic excavator is not of a cabin construction, circumference of which is covered, as in a middle-sized or large-sized excavator. In the compact excavator, it is general that an operator's seat is open to outside. However, in consideration of the falling down of the excavator, it is necessary to take some measures so that an operator is not thrown out of the operator's seat.

From the viewpoint of above, there are contemplated measures for installing a cabin on the upper rotating body of the compact hydraulic excavator. However, in the compact hydraulic excavator, a space above the upper rotating body is severely restricted. Therefore, if an attempt is made to arrange the apparatus cover storing an engine unit and the like and the cabin independently, there poses a problem that the size of a cabin cannot be made larger.

There are further contemplated measures for serving the cabin as the apparatus cover in order to increase the size of a cabin. In this case, it is necessary for the cabin to provide an opening for inspecting the engine and for fueling.

It is preferred that a cabin having as large a size as possible be installed on the upper rotating body of the compact hydraulic excavator to improve the residentiality. However, there is a problem, for the reason described above, that for example, the constitution of the cabin of the middle-sized excavator can not be applied to the compact hydraulic excavator without modification. Further, there is a problem that such a constitution as described above cannot be applied to the compact hydraulic excavator unless re-designing is made including the apparatus cover. Of course, the re-designed cabin cannot be applied to the existing compact hydraulic excavator.

SUMMARY OF THE INVENTION

It is an object of the present invention to provide a compact hydraulic excavator constituted so that a large-sized cabin may be mounted on the compact hydraulic excavator without changing the design of a layout of the existing apparatus cover.

The present invention provides a compact hydraulic excavator having the following constitutions: a lower traveling body, an upper rotating body installed rotatably on the lower traveling body, an apparatus cover risen from a floor plate of the upper rotating body, an operator's seat arranged on the apparatus cover, an operator's seat fixing member for fixing the operator's seat, a cabin provided astride of the apparatus cover and the floor plate, the apparatus cover having a side and a back surface exposed to outside so that the cabin serves as a part of the side and the back surface, and a mounting plate projected substantially in a horizontal direction from the operator's seat fixing member, the side wall of the cabin being risen from the outer circumferential edge of the mounting plate.

In this case, since the cabin is installed on the mounting plate projected from a seat support plate as the operator's seat fixing member, the large-sized cabin can be mounted without being restricted by the arrangement of the apparatus cover. Further, where the present invention is applied to the existing hydraulic excavator, the seat support plate with a mounting plate according to the present invention is mounted in place of the existing seat support plate, whereby the effect of the present invention can be achieved. That is, it is possible to install a larger cabin than the size for the compact hydraulic excavator. Further, since the cabin is installed in the state that the side and the back surface of the apparatus cover are exposed to serve as a part of the side and the back surface of the cabin, it is not necessary to re-design the apparatus cover.

The apparatus cover stores therein an engine unit, a hydraulic apparatus, a fuel tank and so on.

Further, preferably, the back surface of the apparatus cover is constituted to be capable of being opened in a spring-up type, and the rear part of the cabin opposite to the back surface of the apparatus cover is formed to have an inclined surface so as to provide a large spring-up angle.

In this case, the back surface of the apparatus cover to be opened never interfere with the cabin. Since the spring-up angle can be made large, an open area for maintenance can be widened.

Furthermore, preferably, the outer wall of the cabin is connected substantially facing to the outer wall of the rotating frame of the upper rotating body.

In this case, the larger cabin than the size for a compact hydraulic excavator can be installed on the compact hydraulic excavator for which space is restricted.

DESCRIPTION OF THE PREFERRED EMBODIMENTS

Figure 1B:
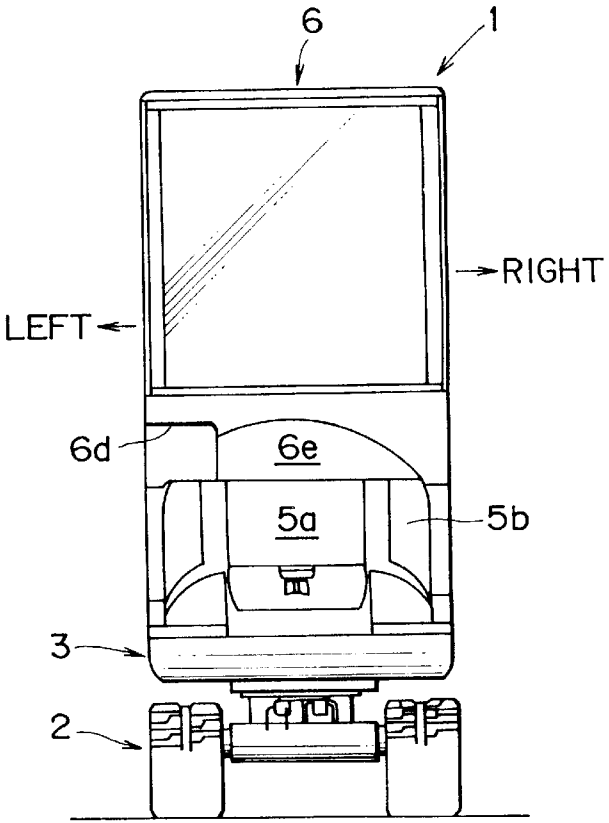
FIG. 1A and FIG. 1B are respectively external views of a hydraulic excavator to which is applied a cabin for a compact hydraulic excavator according to the present invention, particularly, FIG. 1A being a front view, and FIG. 1B being a right side view.

The present invention will be described in detail hereinafter on the basis of one embodiment of the invention shown in the drawings.

Figure 1A:
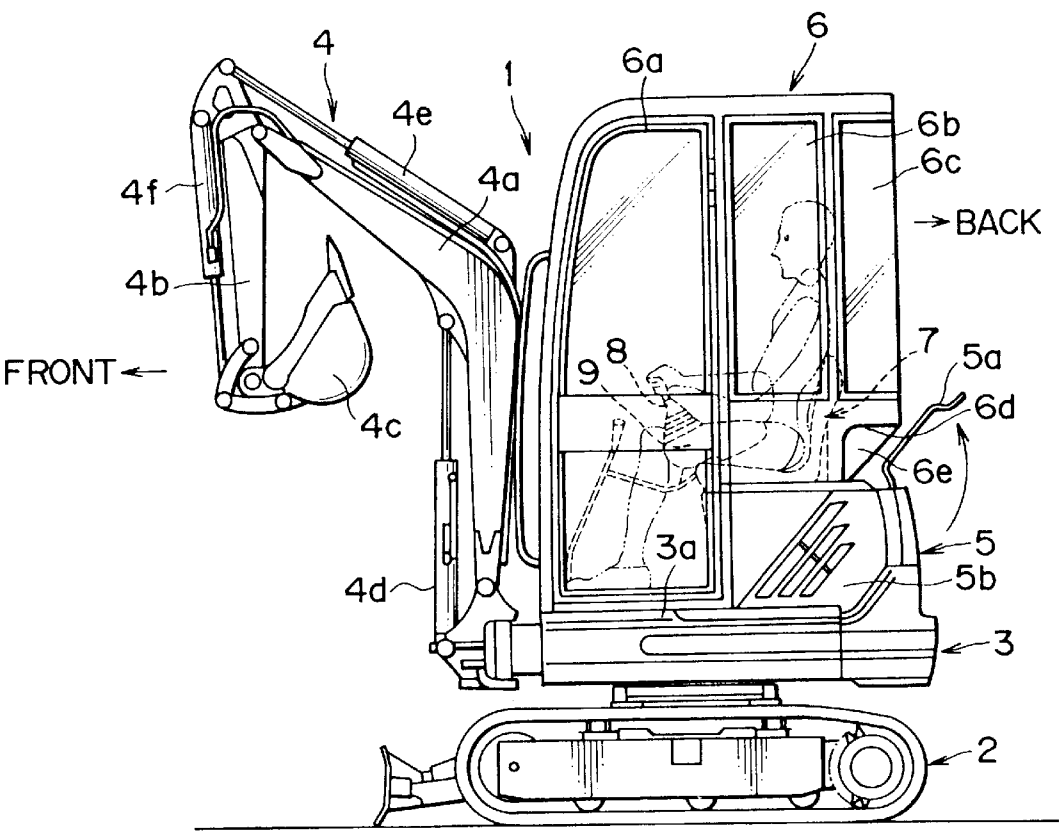

FIGS. 1A and 1B show the constitution of a compact hydraulic excavator to which is applied a cabin for a compact hydraulic excavator according to the present invention. FIG. 1A is a front view, and FIG. 1B is a right side view of the excavator as viewed from the back.

In both the figures, in a compact hydraulic excavator 1, an upper rotating body 3 is installed rotatably on a lower traveling body 2 of a crawler type. A front attachment 4 is provided on the front side of the upper rotating body 3. The front attachment 4 mainly comprises a boom 4*a*, an arm 4*b*, a bucket 4*c*, and a boom cylinder 4*d*, an arm cylinder 4*e* and a bucket cylinder 4*f* for driving the first mentioned respective elements.

On the back side of the upper rotating body 3 is provided an apparatus cover 5 for storing therein an engine unit, a fuel tank, a working oil tank, a battery and so on (not shown). A cabin 6 is provided astride of the apparatus cover 5 and a floor plate 3*a* positioned at operator's feet in the upper rotating body 3.

It is constituted so that an outer wall of the cabin 6 is connected substantially facing to an outer wall of a rotating frame of the upper rotating body 3. Thereby, even the compact hydraulic excavator 1 can secure the greatest residential space. The cabin 6 is interiorly provided with an operator's seat 7. At both lateral sides of the operator's seat 7 is arranged each control box 9 provided with an operating lever 8.

On a side of the cabin 6 is provided a door 6a which is opened and closed when an operator gets on and off. Windows 6*b* and 6*c* of the inlaid type are provided at the rear of the door 6*a*. An inclined surface 6*e* is formed at the lower part behind the cabin 6 so as to form a wedge-like clearance relative to the upper surface of the apparatus cover 5. By the provision of the inclined surface 6*e,* a large spring-up angle can be provided when a rear cover (a rear surface of the apparatus cover) 5*a* of the apparatus cover 5 is opened.

In the figure, 6*d* is formed at the end widthwise of the inclined surface 6*e*. This 6*d* serves as a cut part provided in order to secure a working space during maintenance.

Figure 2:
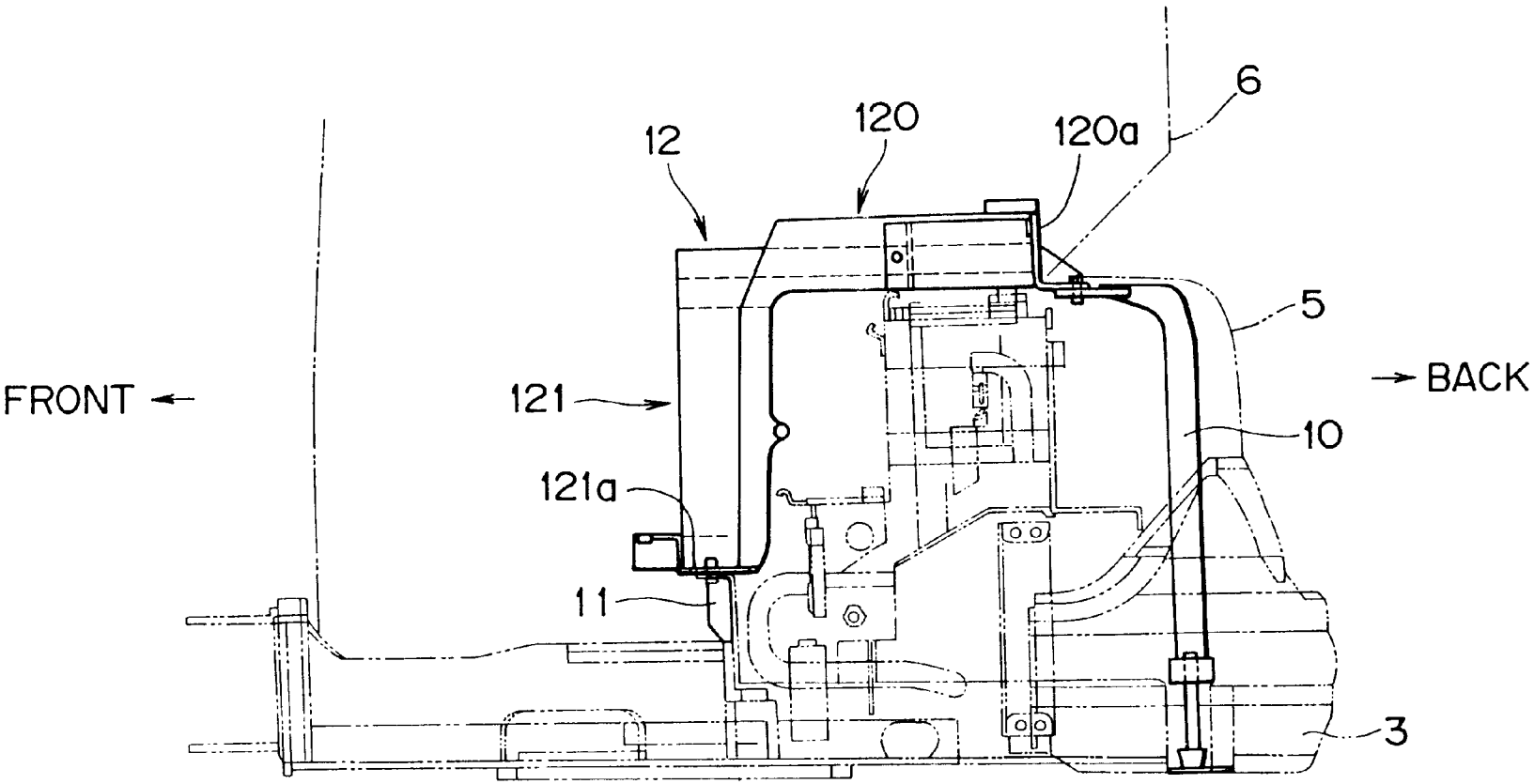
FIG. 2 is a front view showing the fixing construction of a bracket for supporting the cabin.
Figure 3:
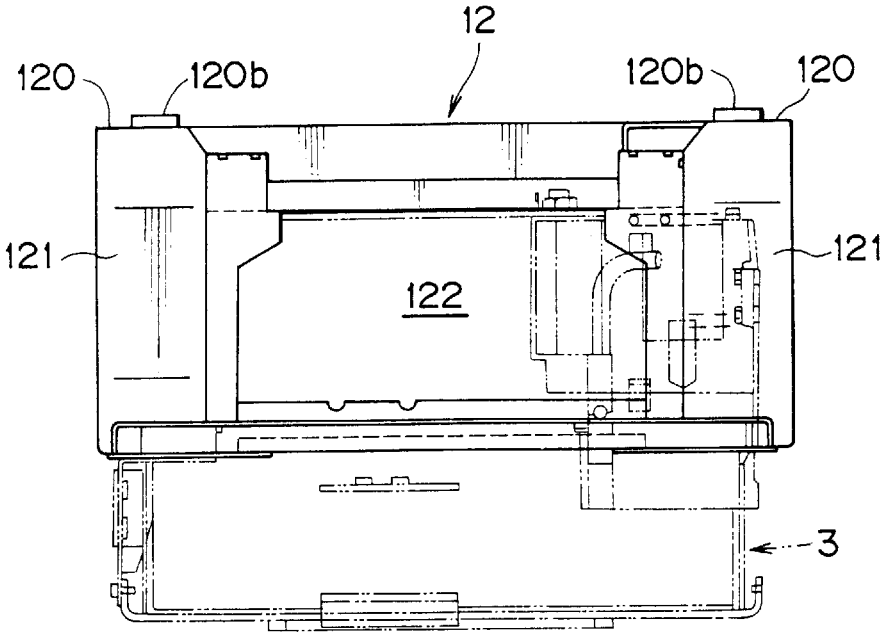
FIG. 3 is a left side view likewise showing the fixing construction.
Figure 4:
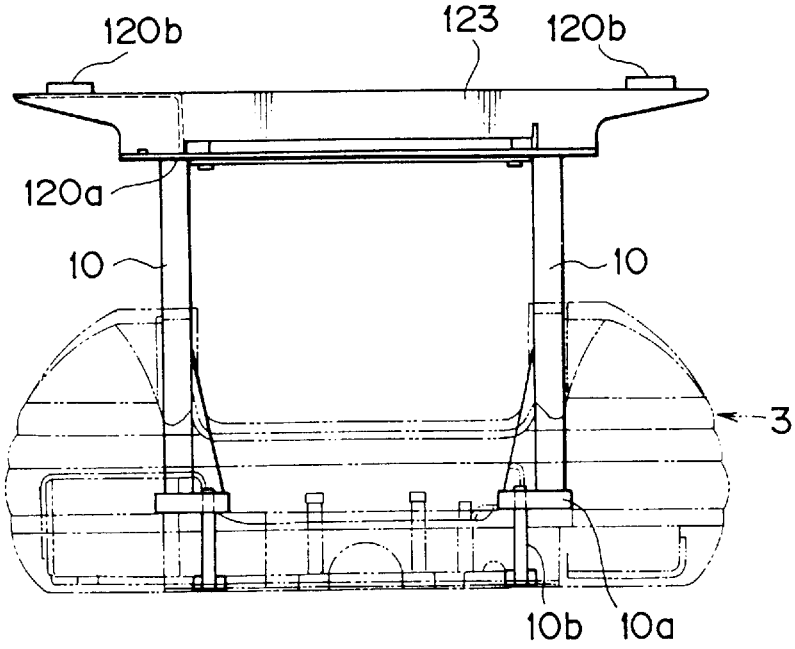
FIG. 4 is a right side view likewise showing the fixing construction.

FIGS. 2 to 4 show the mounting construction for the cabin 6. FIG. 2 is a front view; FIG. 3 is a left side view of the excavator as viewed from front; and FIG. 4 is a right side view thereof as viewed from back.

In FIG. 2, a pair of supports 10, 10 (only one on this side is shown) are stood upright at the rear of the upper rotating body 3. A pair of metal fittings 11, 11 (only one on this side is shown) are projected in the central part of the upper rotating body 3. A bracket 12 for supporting the cabin 6 is secured to those supports 10, 10 and those metal fittings 11, 11.

The bracket 12 is formed into an L-shaped steel so as to avoid the apparatus cover 5. An operator's seat 7, control boxes 9 and so on are disposed on the bracket 12.

Connecting metal fittings 120*a* formed from an L-shaped steel to be connected to the supports 10, 10 is provided at the rear end of an upper plate 120 of the bracket 12. On the other hand, connecting metal fittings 121*a*, 121*a* to be connected to the metal fittings 11, 11 are provided on the lower ends of front plates 121, 121 (only one on this side is shown) of the bracket 12.

The pair of front plates 121 are arranged apart widthwise of the excavator, as shown in FIG. 3. An opening 122 therebetween is shielded by a front panel formed with a blow-off hole of a heater not shown.

Each rear end of the upper plate 120 is connected widthwise of the excavator by a web-like connecting plate 123. The connecting metal fittings 120*a* is secured to the connecting plate 123.

A plate-like connecting leg 10*a* is provided at the lower end of each of the supports 10, 10. The connecting leg 10*a* is secured to the rotating frame through a bolt 10*b*. It is noted that a fixed seat 120*b* for locating and fixing the frame of the cabin 6 is mounted at the rear end of and outwardly of each of the upper plate 120.

Figure 5:
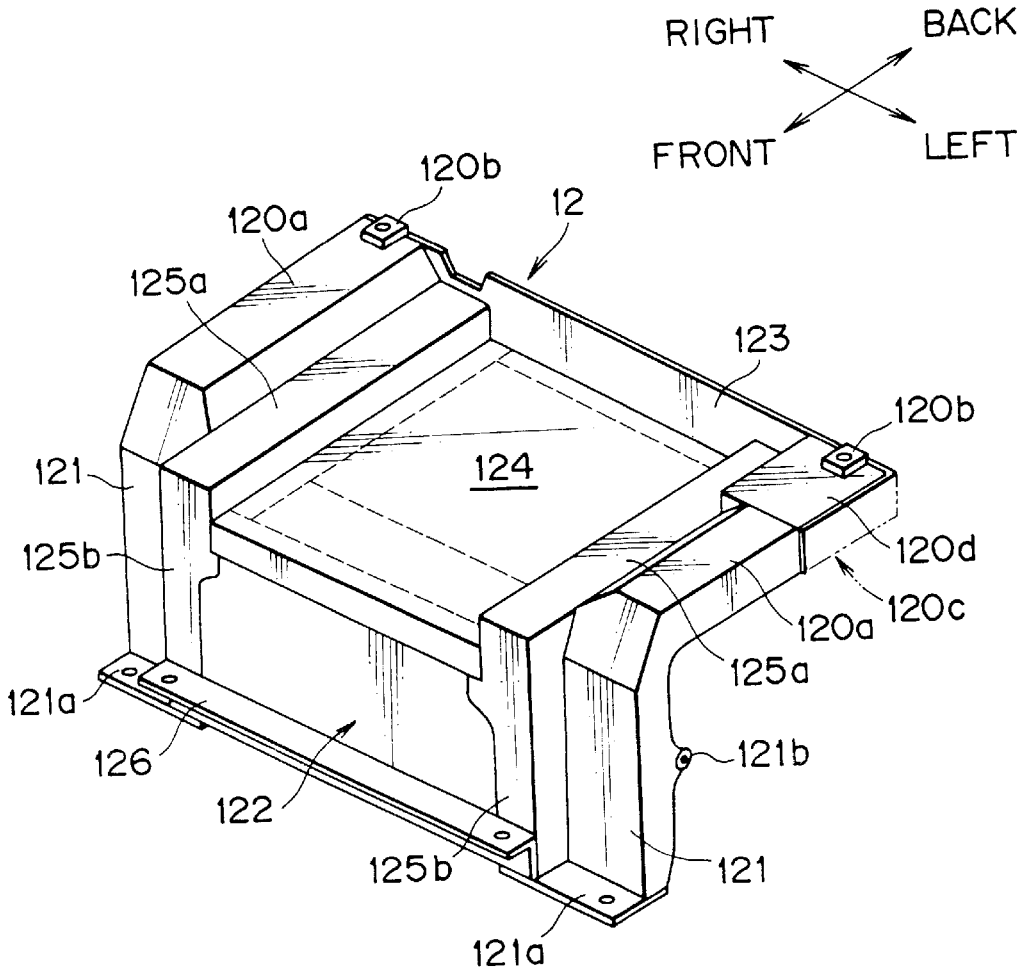
FIG. 5 is a perspective view showing the constitution of a bracket.

FIG. 5 shows the bracket 12 in an enlarged scale.

In the figure, the bracket 12 has an operator's seat fixing plate (a seat support) 124 on which the operator's seat 7 is mounted. Each control box fixing part 125*a* formed from a tube for mounting a control box is connected to both sides (widthwise of the excavator) of the operator's seat fixing plate 124. An upper plate 120*a* is connected externally of the control box fixing part 125*a*. The upper plate 120*a* extends outward along the upper surface of the apparatus cover 5. The upper plate 120*a* functions as a mounting plate for mounting the cabin 6.

A second front plate 125*b* is suspended from the front end of the control box fixing part 125*a*. The second front plate 125*b* is connected to the front plate 121. A connecting plate 126 formed of L-shaped steel is mounted at the lower end of the second front plate 125*b*. The rear edge of the floor plate 3*a* is connected to the connecting plate 126.

Mounting seats 121*a*, 121*a* are provided at the lower ends of the respective front plates 121. The mounting seats 121*a*, 121*a* are secured to the floor plate 3*a* through bolts not shown. A connecting piece 121*b* with a hole to be connected to a frame of a side cover 5*b* (see FIGS. 1A and 1B) is provided on the side of the front plate 121.

A bag part 120*d* in the shape, in which a corner (indicated by dash-dotted contour lines) 120*c* is cut, is provided at the rear end of the upper plate 120*a* on the left side. This bag part 120*d* is provided to open the side cover 5*b* so that the working space is secured when maintenance takes place.

In this manner, the bracket 12 is constituted separately from the apparatus cover 5 so as to cover the upper surface and the front surface of the apparatus cover 5. Moreover, the upper plate 120*a* is over-hung widthwise of the excavator for expansion. Because of this, the size of the cabin 6 installed on the bracket 12 can be enlarged.

Also, the outer edge of the upper plate 120*a* is extended so as to substantially meet the contours of the rotating frame of the upper rotating body 3. Because of this, the cabin 6 of which bottom is substantially equal to a floor area of the rotating frame can be realized. That is, it is possible to form a cabin equal to the middle-sized machine with respect to the compact hydraulic excavator 1.

I claim:

1. A hydraulic excavator comprising:

a lower traveling body;

an upper rotating body having a floor plate and rotatably mounted on the lower traveling body;

an apparatus cover attached to the floor plate;

a bracket mounted to the upper rotating body via a support attached to the upper rotating body;

an operator's seat mounted on the bracket; and a cabin positioned on the apparatus cover and mounted to said bracket.

2. The hydraulic excavator according to claim 1, further comprising an engine unit, a hydraulic apparatus, and a fuel tank stored in said apparatus cover.

3. The hydraulic excavator according to claim 1 wherein a rear surface of said apparatus cover is mounted to said upper rotating body via a spring-up system.

4. The hydraulic excavator according to claim 3 wherein a rear part of said cabin opposite to the rear surface of said apparatus cover is an inclined surface.

5. The hydraulic excavator according to claim 4 wherein said cabin has a cut at a rear lower part of said cabin and at an end widthwise of said cabin.

6. The hydraulic excavator according to claim 1 wherein an outer wall of said cabin is connected substantially facing to an outer wall of a frame of said upper rotating body.

7. The hydraulic excavator according to claim 1 further comprising a seat support plate.

* * * * *